US005088741A

United States Patent [19]

Simonetti

[11] Patent Number: 5,088,741

[45] Date of Patent: Feb. 18, 1992

[54] MODULAR FIRING GROUND

[76] Inventor: Andrea Simonetti, No. 21, Via Carlo Zucchi, 00165 Roma, Italy

[21] Appl. No.: 474,855

[22] PCT Filed: May 9, 1989

[86] PCT No.: PCT/IT89/00034

§ 371 Date: Nov. 5, 1990

§ 102(e) Date: Nov. 5, 1990

[87] PCT Pub. No.: WO89/11076

PCT Pub. Date: Nov. 16, 1989

[30] Foreign Application Priority Data

May 10, 1988 [IT] Italy ..... 47939 A/88

[51] Int. Cl.[5] ..... F41J 1/12; F41J 1/18

[52] U.S. Cl. ..... 273/410; 273/406

[58] Field of Search ..... 273/410, 404, 406

[56] References Cited

U.S. PATENT DOCUMENTS

| | | | |
|---|---|---|---|
| 2,670,959 | 3/1954 | Broyles | 273/410 |
| 4,509,301 | 9/1985 | Head | 273/410 X |
| 4,512,585 | 4/1985 | Baravaglio | 273/410 |
| 4,819,946 | 4/1989 | Kahler | 273/410 X |

FOREIGN PATENT DOCUMENTS

| | | |
|---|---|---|
| 2125180 | 12/1972 | Fed. Rep. of Germany . |
| 1558501 | 2/1969 | France . |
| 2292811 | 6/1976 | France . |
| 20777127 | 10/1976 | France . |
| 2504669 | 10/1982 | France . |

*Primary Examiner*—William H. Grieb

*Attorney, Agent, or Firm*—Mason, Fenwick & Lawrence

[57] ABSTRACT

This invention relates to a firing ground consisting of standard modules (1, 21, 25, 36, 52) which are preferably realized according to the ISO standards, the firing ground comprising in particular a ball-arrester module (1), one or more intermediate modules (21) which are arranged in front of the ball-arrester module (1), a so-called "firing positions" module (25 ) arranged in front of the last one of the intermediate modules (21), and a so-called "firing controller position" module (36) provided next to the "firing positions" module (25), each one of the modules being provided with structure (11) for quick connection to the adjacent modules, as well as with structure (12) for electric and/or hydraulic lines and/or adjacent module ducts connection, and with tight sealing along the connection wall with the adjacent module, with wheels (20) for motion during the assembling operation of the firing ground, and with inside heat- and sound-insulation (14), in addition to a number of other ancillary modules which can be provided according to any requirement at hand.

19 Claims, 4 Drawing Sheets

MODULAR FIRING GROUND

This invention relates to a modular firing ground and more particularly it relates to a shooting range made up of standard modules which are transportable and can be connected according to any requirements, said modules being provided with all ancillary equipment necessary to obtain an operating shooting range and being also provided with means for quick connection to other modules.

Shooting ranges are built at present by arranging masonry works underground or at ground level, or also on raised floors of already existing buildings.

The problems stemming from such kind of structures are of various types and quite evident to those who are skilled in the art.

First of all, the construction costs are very high, and this is particularly true of indoor shooting ranges.

Moreover, the realization of masonry work shooting ranges asks for extremely long working times which are strongly affected by local weather conditions.

Once the shooting range has been constructed, the area intended for the same cannot be exploited for other aims any more.

Moreover, due to the particular features of the shooting ranges themselves, it is impossible after realizing them to change their sizes (length or number of firing lines) according to any different specific requirements, unless definitely high costs are faced.

Accordingly, it can be certainly set forth that shooting ranges constructed according to traditional techniques having masonry structures or prefabricated structures of the traditional type, are very costly to realize, have a poor flexibility of employment and are inhomogeneous to one another.

In U.S. Pat. No. 4,509,301 it is described a "Modular shooting range" comprising a shooting booth, for an individual shooter, communicating with the interior of an elongated firing tube. The end of the firing tube is closed by a bullet backstop which deflects bullets fired and collects them in a trough of liquid. Each of the booth, tube and backstop can be at least partially prefabricated.

In French patent No. 1,558,501 it is described a process to assembly a prefabricated house.

DE patent No. 2,125,188 describes a process for the realization of transportable room units, each one independent from the other.

In the French patent No. 2,292,811 it is described a transportable prefabricated house unit, and in French patent No. 2,077,127 it is described a housing having a reinforced frame.

Finally, a movable firing ground, disposed on a truck, is described in French patent No. 2,504,669.

Thus, it is quite clear that there is a need for shooting ranges such as those of the type suggested by the present invention, which are realized through assembling previously realized standard modules which are very easy to transport.

In that way, the assembling times of the shooting range in the yard are remarkably shortened (50–100 times shorter) in addition to a strong reduction of costs (2–3 times lower), and the characteristics of the shooting range obtained are made homogeneous with respect to those of the other shooting ranges.

However, especially in the case of the shooting range according to the present invention, the structural features of the shooting range can be modified after its realization, and according to the specific requirements of the purchaser, with no need for long and costly additional work.

Moreover, employing a solution like that proposed by the Applicant, it is possible in case of unrepairable damages to substitute very quickly the module in question.

The realization of the shooting range of the present invention according to ISO standards allows the same to be easily transported with any transportation means, even overseas.

In addition, if the modules are realized so that they can be overlapped to one another, it is possible to double the performance of the shooting range without increasing its horizontal overall dimensions.

The light weight of the structures allows the shooting range to be constructed on top of already existing buildings or inside the same.

These and other achievements are obtained according to the present invention by realizing a shooting range consisting of transportable modules, each one of said modules being provided with means for rapidly assembling the same and for quickly interconnecting operatively a module with other equal modules or with modules which are different by their inner features, each module being internally provided with specific equipment for realizing the aims for which the module itself is intended.

Accordingly, it is a specific object of the present invention to realize a shooting range comprising a bullet arresting module, one or more intermediate modules arranged in front of said bullet-arresting module, a so-called "firing positions" module arranged in front of the last one of said intermediate modules, characterized in that it is provided a so-called "firing controller position" arranged next said "firing positions" module, in that each one of said modules is provided with means for rapid connection with the adjacent modules, as well as with means for connecting electric and/or hydraulic lines and/or ducts of the adjacent modules, with sealing means along the connection walls with the adjacent modules, with means for motion during the assembling operation of the shooting range, and with inside heat- and sound-insulating means, and in that each one of said modules is realized according to the ISO standards.

Preferably the firing axis of the shooting range according to the present invention is realized so as to be at right angles to the main axis of the modules.

In addition to the modules previously pointed out, according to the present invention a so-called "firing pre-positions" module, a "thermoventilation" module, and an "ancillary equipment" module can be provided, besides a various number of intermediate modules which are useful for increasing the shooting range length.

Again according to the present invention, there is the possibility of overlapping two shooting ranges or of putting them side by side, according to any requirement.

The shooting range so realized can be provided with strengthening structures or with external covering fitting structures.

The modules which the shooting range according to the present invention is made up of can have their upper portions telescopically extensible, while the motion means can consist of wheels running on rails.

The bullet-arresting module will be provided with a covering, as well as with side walls and a fixed floor, and preferably with a shutter-bearing end wall. The equipment making up the ball-arrester can consist of any kind of bullet-arresting, from the well known types of simple construction and made up for instance of heaps of material, to the bullet-arresters of the continuous regeneration type.

Moreover, means will be provided for collecting splinters and lead powders.

The intermediate modules which are open both in the front and in the back part have side walls sloping innerwards and preferably they have a floor with folding side wings to allow the module to be inspected.

Dividing walls will be provided in the "firing positions" modules for ballistic protection between a firing position and the other ones, said walls being fastened to metallic frames which are integral with the supporting structure, and floors will be provided which are preferably made up of a compact wood mix and smooth rubber for splinter-proofing and to prevent bullets from bouncing.

Such modules can be equipped with any fittings required for obtaining the best firing conditions (control means for lights and for target motion, sight and sound means, intercom headphones, and so on).

Further it is possible to provide a device for detecting carbon monoxide traces in the environment.

The "firing controller position" module is equipped with a box or cab having transparent walls consisting of Perspex, or polycarbonate or any other transparent material, as well as with a ventilation system and all necessary fittings.

On the contrary, as regards the so-called "ancillary equipment" module, the same will in particular be provided with a self-contained power supply group as well as with hygienic-sanitary equipment so that the shooting range in question according to the present invention can be constructed even in uninhabited areas.

Said ancillary equipment module can be indifferently arranged at the front or at the rear end of the shooting range, or said module can also be provided at a position adjacent to the structure and independent of the same.

Moreover, a purposely designed inlet or entrance module can be additionally provided.

This invention will be disclosed in the following according to some preferred embodiments of the same with particular reference to the figures of the enclosed drawings, wherein.

Figure 3:
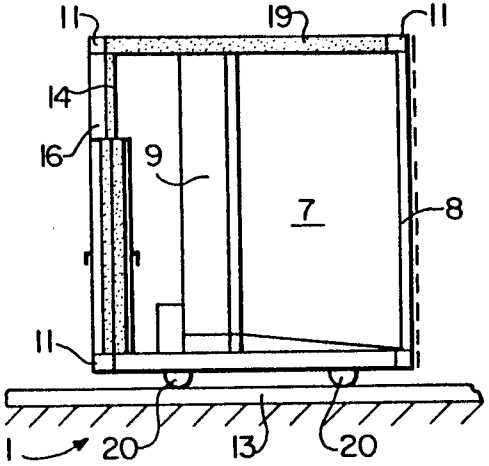
FIG. 3 is a longitudinal vertical cross-sectional view of the module of FIG. 1.
Figure 4:
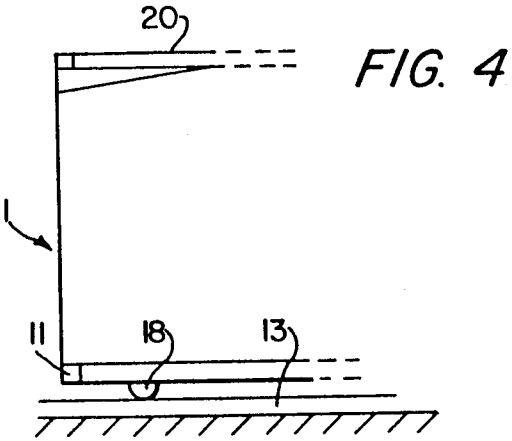
FIG. 4 is a side view of the module of FIG. 1.
Figure 1:
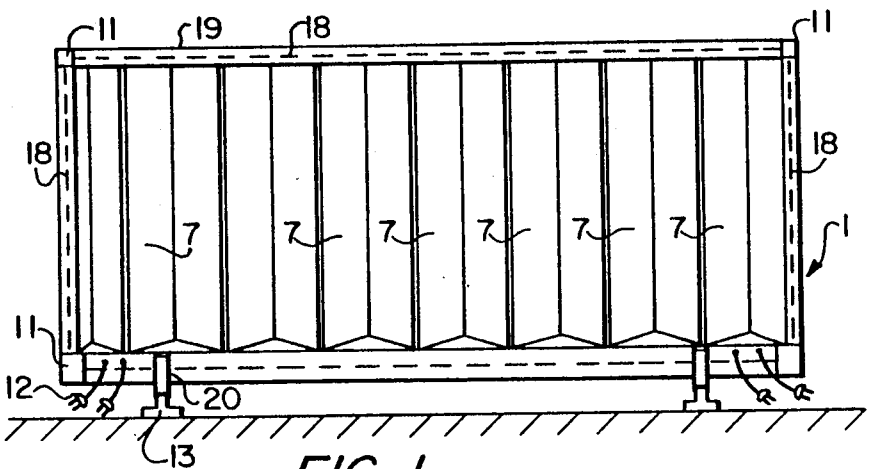
FIG. 1 is a transverse vertical cross-sectional view of a bullet-arresting module of the shooting range according to the present invention.

Observing now the figures from FIG. 1 to FIG. 4, the bullet-arresting module 1 is provided with an external shutter 2 for entrance from the rear part of the module, said shutter having a remote controlled electric lock, said module also having an inner safety shutter 3 as well as devices 4 for request and allowance to enter through the rear part. The reference numeral 5 points out a light signal of the shutter 2, whereas number 6 points out the lights that allow said ball-arresting module 1 to be inspected from its rear part.

The true and correct ball-arrester device according to the embodiment shown in the figures comprises a number of ballistic plates 7 for conveying bullets, as well as a number of vertical ball guard blades 8, screw conveyors 9 at the ends of two converging plates 7 for slowing down bullets, and tight sealing devices 10 for collecting and extracting bullets.

The module 1 is provided with corner blocks 11 for rapid connection with the adjacent modules of the shooting range according to the present invention.

The connection of the feeding lines with those of the other modules occurs through the rapid-insertion flexible connection 12.

Figure 2:
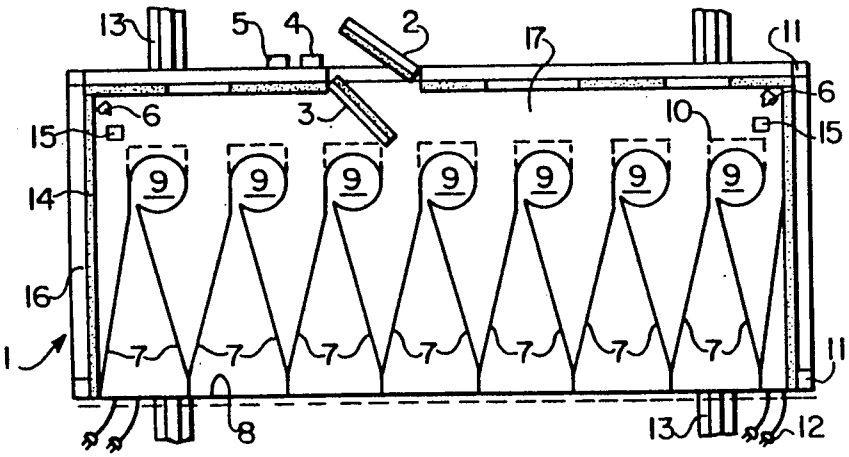
FIG. 2 is a horizontal cross-sectional view of the module of FIG. 1.

The reference numeral 13 in FIG. 2 points out the rails for aligning and assembling the modules of the shooting range.

The module 1 is coated inside with sound-insulating and sound-absorbing materials 14 and it is provided with loudspeakers 15 for sound communications.

The external supporting frame 16 is made up of structural steel.

A space 17 is provided in the rear part of the module 1 for inspection.

Sealing gaskets 18 are provided along the perimetrical part at the connection zones between one module and the next, whereas the roof 19 will be provided on top.

Each module is provided with wheels 20 for allowing it to move on the ground.

Figure 7:
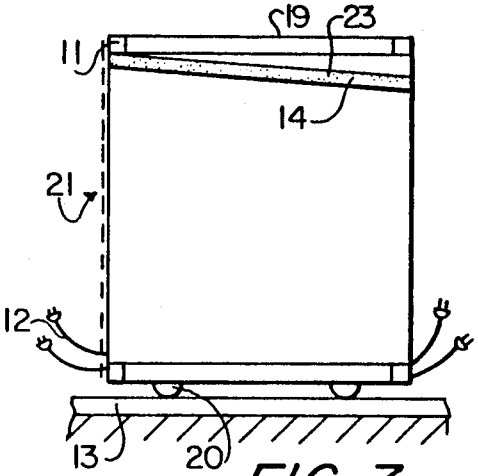
FIG. 7 is a longitudinal vertical cross-sectional view of the module of FIG. 5.
Figure 10:
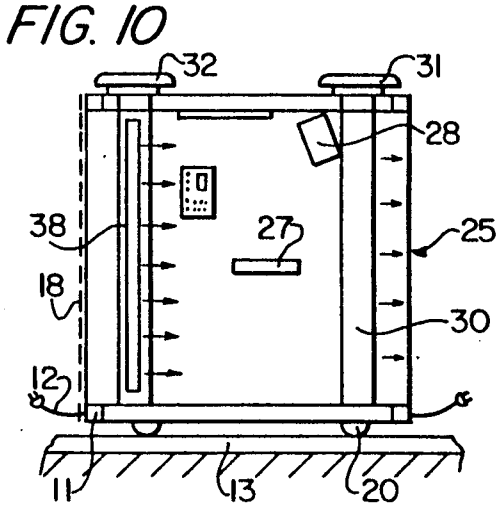
FIG. 10 is a longitudinal vertical cross-sectional view of the module of FIG. 8.
Figure 5:
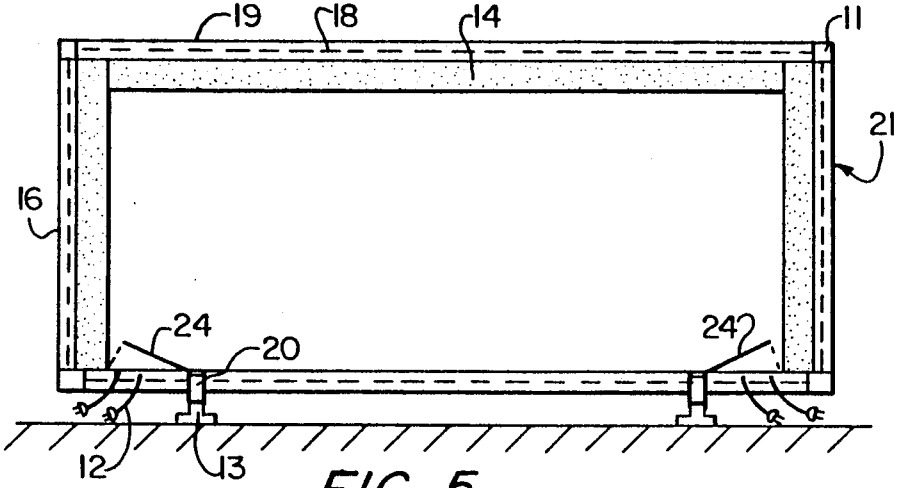
FIG. 5 is a transverse vertical cross-sectional view of an intermediate module of the shooting range according to the present invention.
Figure 6:
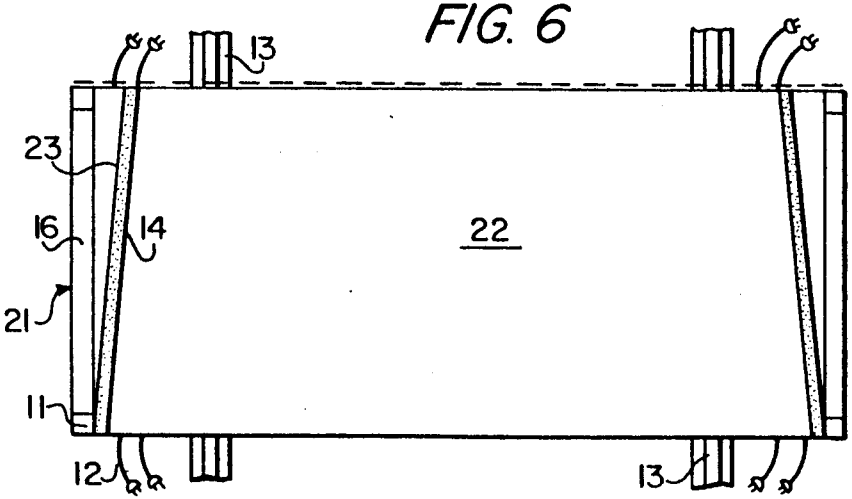
FIG. 6 is a horizontal cross-sectional view of the module of FIG. 5.
Figure 8:
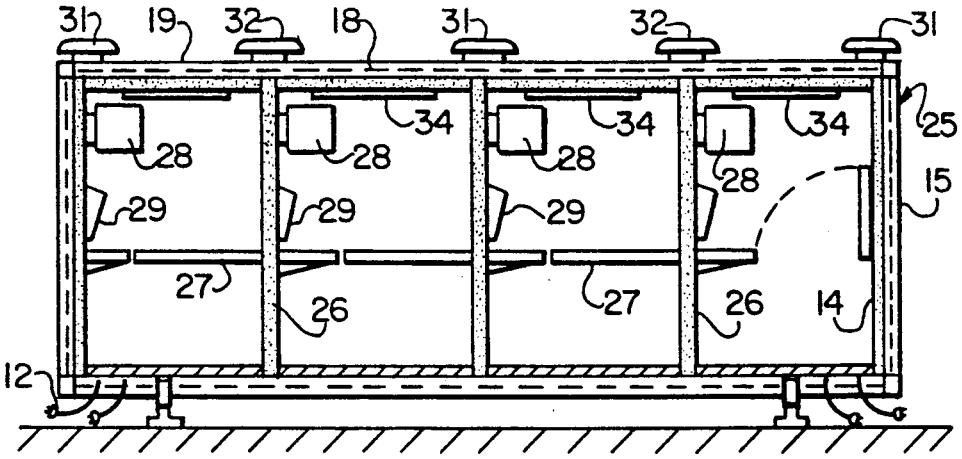
FIG. 8 is a transverse vertical cross-sectional view of a so-called "firing positions" module of the shooting range according to the present invention.
Figure 9:
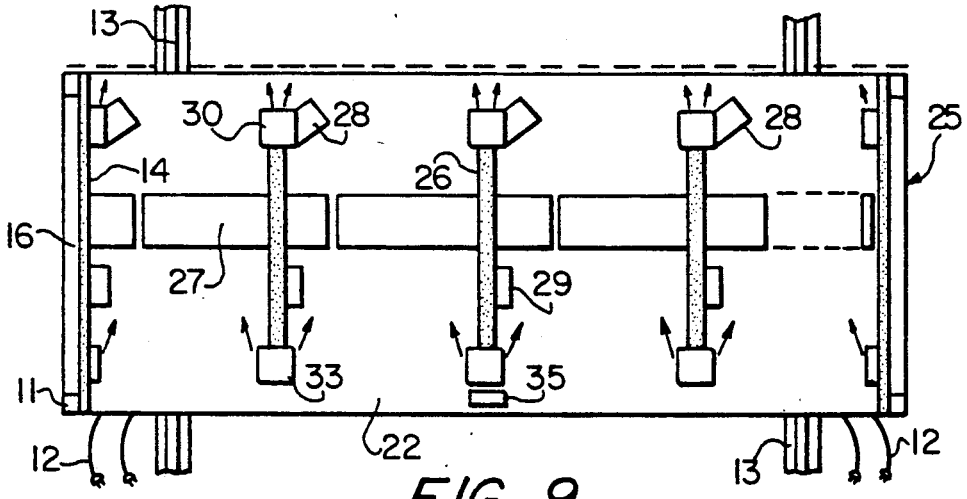
FIG. 9 is a horizontal cross-sectional view of the module of FIG. 8.

With reference now to FIGS. 5–7, an intermediate module 21 is shown which is completely empty in the central portion and whose object is just that of making the shooting range of the present invention longer.

Such module comprises a floor 22 coated with rubber, whereas the plates 23 consisting of ballistic steel are provided between the external supporting frame 16 made up of structural steel and the sound-absorbing, sound-insulating coating 14.

Two side wings 24 are further provided, allowing the plant channels to be inspected.

The "firing positions" module 25, besides the structures already disclosed with reference to the modules 1 and 21, is provided with dividing walls 26 arranged between one marksman and the next said walls being made up of bullet-proof and anti-rebound material and of sound-absorbing material.

Each one of the firing positions is provided with overturning planes 27 for supporting the weapon and with a monitor 28 for the firing detection television circuit.

Moreover, a personal control board 29 is arranged on the dividing walls 26 for the marksman's use.

The module 25 is provided with channels 30 for introducing a flow of cold air, as well as with fans 31 for causing air to flow, and with heater fans 32 for introducing hot air and with the corresponding channel 33 for the flow of said air.

The reference numeral 34 finally points out the lights for illuminating the individual firing positions.

Some means 35 will be provided inside the module 25 for detecting carbon monoxide.

Figure 11:
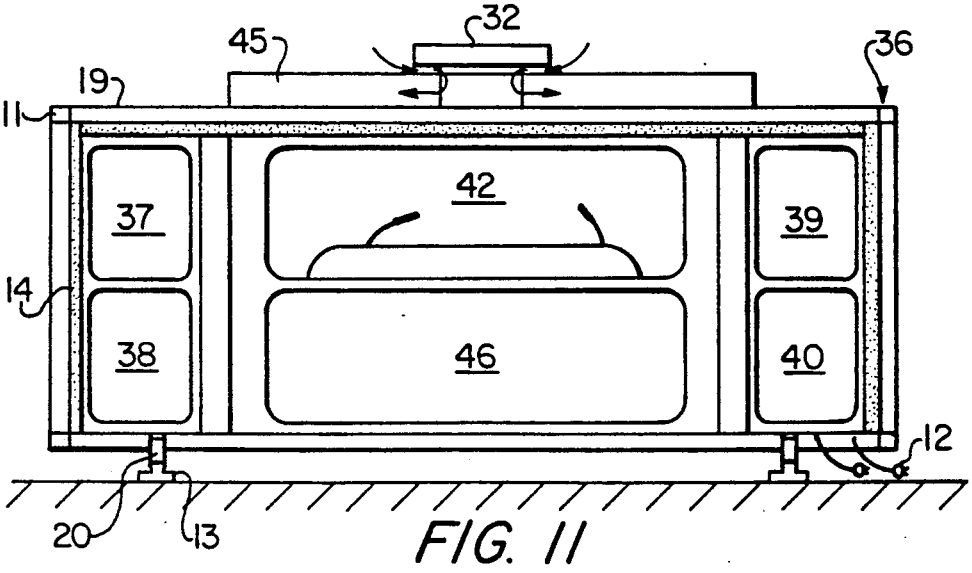
FIG. 11 is a transverse vertical cross-sectional view of a so-called "firing controller position" module of the shooting range according to the present invention.
Figure 13:
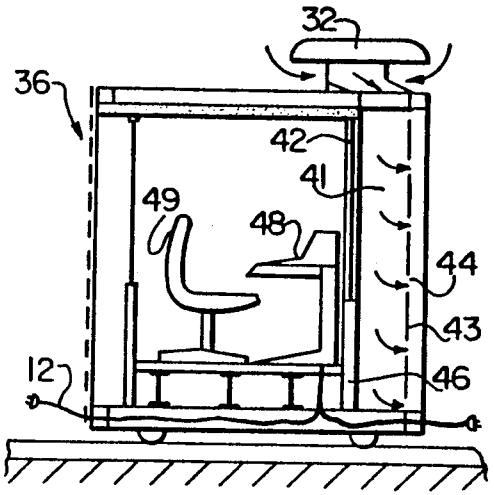
FIG. 13 is a longitudinal vertical cross-sectional view of the module of FIG. 11.
Figure 12:
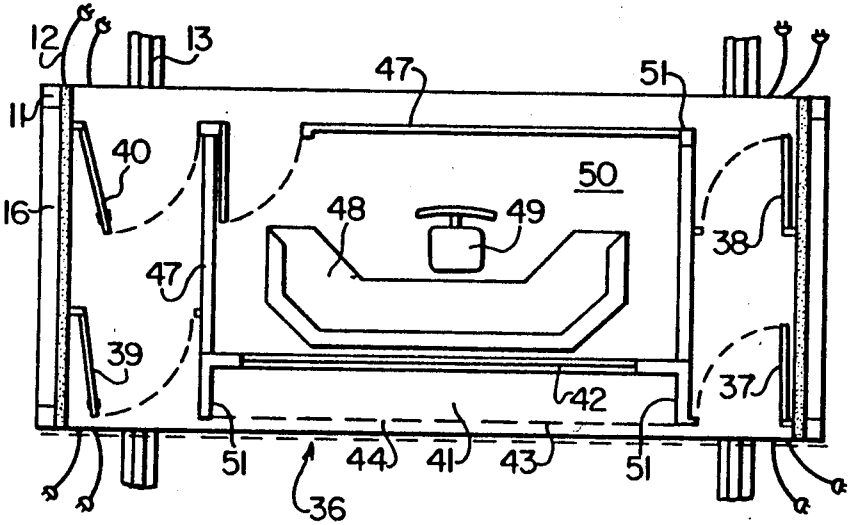
FIG. 12 is a horizontal cross-sectional view of the module of FIG. 11.

In the so-called "firing controller position" module 36 (FIGS. 11, 12 and 13), two doors 37 and 38 are provided for entrance to the shooting range, said doors being provided with bullet-proof glass, remote controlled electric lock, bullet-proof boards, microswitches for opening and closing signalling, intercom, semaphores and so on, two outlet doors 39 and 40 bearing similar fittings being also provided in said module.

The reference numeral 41 points out the air distribution "plenum" which is made up of the wall 42 bearing a multi-layer, insulating splinter- and bullet-proof double glass, of a polycarbonate or Perspex plate 43 drilled at 44 so as to distribute hot air towards the marksmen. Said "plenum" 41 is connected to the external channel 45 that introduces air into the same.

The wall 42 is the front upper wall of the box or cab of the firing controller, the front lower wall 46 of said box being made up of bullet-proof material.

The box of the firing controller which is delimited by side and back walls 47 and is made up of a VIS-ARM glass type comprises a control console 48 for controlling the various functions of the firing ground, and a seat 49 on a raised floor 50.

Said module 36 additionally comprises communication and entrance semaphore means 51.

Figure 15:
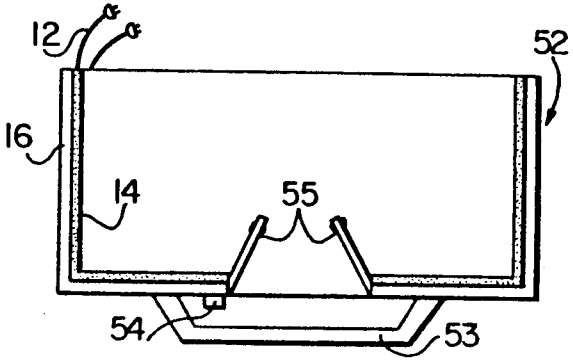
FIG. 15 is a horizontal cross-sectional view of the module of FIG. 14.
Figure 14:
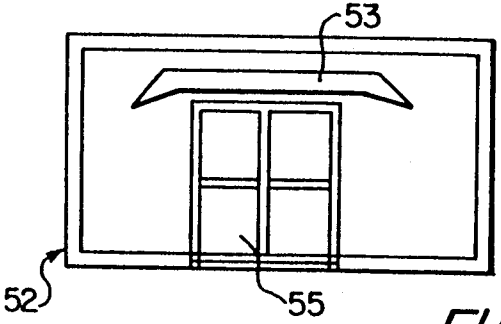
FIG. 14 is a front view of an inlet or entrance module of the shooting range according to the present invention.

Finally, FIGS. 14 and 15 show an entrance module 52 to the firing ground, in which module a cantilever roof 53, and intercom 54 and the entrance doors 55 are provided.

It is quite clear that it is possible to realize shooting ranges suitable to any requirements (as regards performance and costs) and which can be easily integrated with other modules by merely combining the modules disclosed above, by connecting the same along their lengths or by putting them side by side or overlapping a module to other ones.

This invention has been disclosed with specific reference to some preferred embodiments of the same, but it is to be understood that modifications and/or changes can be introduced by those who are skilled in the art without departing from the spirit and scope of the invention for which a priority right is claimed.

I claim:

1. A shooting range comprising:

a bullet-arresting module for arresting bullets fired therein;

a firing position module for accommodating at least one marksman;

at least one intermediate module positioned intermediate said bullet-arresting module and said firing position module; and a firing controller module for controlling operation of said shooting range, said firing controller module being adjacent said firing position module;

wherein each of said modules includes:

rapid connection means for rapidly connecting said module to an adjacent one of said modules;

electric lines, hydraulic lines, and ducts and service connection means for connecting at least one of said electric and hydraulic lines and ducts of one of said modules to a respective one of said electric and hydraulic lines and ducts of an adjacent one of said modules;

at least one connecting wall for connecting said module to a connecting wall of an adjacent one of said modules and sealing means for sealingly connecting adjacent connecting walls;

moving means for moving said module when said shooting range is being assembled; and sound insulation and heat insulation means; and wherein each of said modules complies with ISO standards.

2. A shooting range according to claim 1, wherein said shooting range has a firing axis and wherein said bullet-arresting module, said firing position module, said at least one intermediate module, and said firing controller module are substantially rectangular in shape having a pair of opposed longer sides and a pair of opposed shorter sides, adjacent modules being connected at said longer sides, and wherein said modules each have a main axis parallel to said longer sides, said main axis being at right angles to said firing axis of said shooting range.

3. A shooting range according to claim 1, further comprising a pre-firing position module positioned forwardly of said firing position module.

4. A shooting range according to claim 1, further comprising a thermoventilation module for providing heat and ventilation to said modules.

5. A shooting range according to claim 1, further comprising an ancillary equipment module for housing ancillary equipment.

6. A shooting range according to claim 5, wherein said ancillary equipment module includes a self-contained power supply and hygiene and sanitary fittings.

7. A shooting range according to claim 6, wherein said ancillary equipment module is positioned adjacent said bullet-arresting module, said firing position module, said at least one intermediate module, and said firing controller module, and is self-contained with respect to said bullet-arresting module, said firing position module, said at least one intermediate module, and said firing controller module.

8. A shooting range according to claim 1, further comprising an entrance module for providing entrance to and exit from said shooting range.

9. A shooting range according to claim 1, wherein each of said bullet-arresting module, said firing position module, said at least one intermediate module, and said firing controller module includes walls, a ceiling, and a floor, said walls, ceiling, and floor being made of a bullet-proof material.

10. A shooting range according to claim 1, further comprising at least one additional module positioned adjacent one of said bullet-arresting module, said firing position module, said at least one intermediate module, and said firing controller module.

11. A shooting range according to claim 1, further comprising ancillary covering structures covering said modules.

12. A shooting range according to claim 1, wherein each of said modules has an upper portion, said upper portion being vertically telescopically extensible.

13. A shooting range according to claim 1, wherein said moving means comprises rails and wheels running on said rails.

14. A shooting range according to claim 1, wherein said bullet-arresting module comprises a floor, a roof opposite said floor, a pair of opposed fixed side walls, and an end wall, said end wall including shutters for providing entrance to and exit from said bullet-arresting module.

15. A shooting range according to claim 14, wherein said bullet-arresting module further comprises means for collecting splinters and lead powders.

16. A shooting range according to claim 1, wherein said at least one intermediate module comprises opposed, inwardly sloping side walls, opposed open front and rear ends, and a floor, said floor including folding side wings.

17. A shooting range according to claim 1, wherein said firing position module includes a floor, a supporting structure, metallic frames integral with said supporting structure, a plurality of adjacent firing positions, and a plurality of dividing walls separating adjacent firing positions for providing ballistic protection between adjacent firing positions, said dividing walls being fastened to said metallic frames, and said floor being made of a compact wood mix and a splinter-proof smooth rubber for preventing bullets from bouncing.

18. A shooting range according to claim 1, further comprising means for detecting carbon monoxide traces in the environment of said shooting range.

19. A shooting range according to claim 1, wherein said firing controller module includes a cab having a transparent wall, a ventilation system, and means for controlling operation of said shooting range.

* * * * *